United States Patent [19]

Perrella

[11] 3,964,609

[45] June 22, 1976

[54] DISPENSING CONTAINER ASSEMBLY

[76] Inventor: Emilio Perrella, via S. Carlo, Segrate (Milan), Italy

[22] Filed: Dec. 3, 1973

[21] Appl. No.: 420,898

[30] Foreign Application Priority Data

Dec. 28, 1972 Italy ..... 33773/72

[52] U.S. Cl. ..... 206/540; 220/254; 220/263; 220/338

[51] Int. Cl.[2] ..... B65D 83/04; B65D 43/16

[58] Field of Search ..... 220/254, 255, 262, 263, 220/264, 306, 338; 206/249, 250, 259, 264, 265, 266, 528, 534.1, 534.2, 540

[56] References Cited

UNITED STATES PATENTS

| | | | |
|---|---|---|---|
| 1,011,874 | 12/1911 | Stephenson | 220/254 |
| 1,545,317 | 7/1925 | Hasselroth | 206/250 X |
| 1,727,291 | 9/1929 | Judd | 220/264 |
| 2,327,120 | 8/1943 | McCoon | 206/250 |
| 2,479,917 | 8/1949 | Feurer | 220/264 |
| 2,635,792 | 4/1953 | Amand et al. | 220/263 X |
| 2,960,264 | 11/1960 | Walter | 206/266 X |
| 3,041,692 | 7/1962 | Olila | 206/540 X |
| 3,059,762 | 10/1962 | Yoshimoto | 206/534.2 X |

*Primary Examiner*—William Price
*Assistant Examiner*—Stephen Marcus
*Attorney, Agent, or Firm*—Holman & Stern

[57] ABSTRACT

A container is disclosed for dispensing loose, solid, small size articles, like tablets, pills and other confectionary products, comprising a casing and a closure device, the latter including a lid member having a portion extending beyond the hinge axis between the lid and the casing, and operating means pivoted to the container and adapted to engage said portion of the lid, whereby on actuating said operating means the lid is opened by rotating around the hinge axis, the lid being further urged towards its closure condition by elastic means.

8 Claims, 14 Drawing Figures

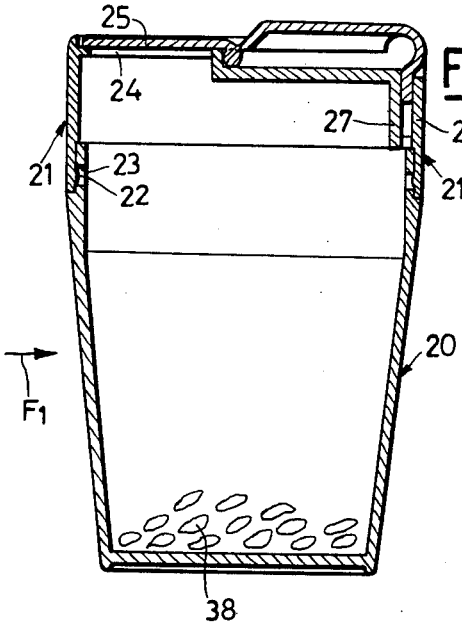
Fig.1
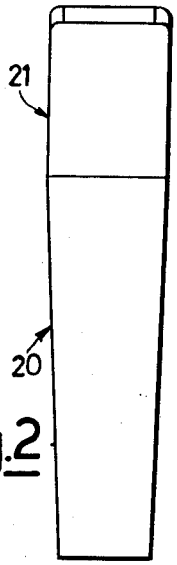
Fig.2
Fig.3
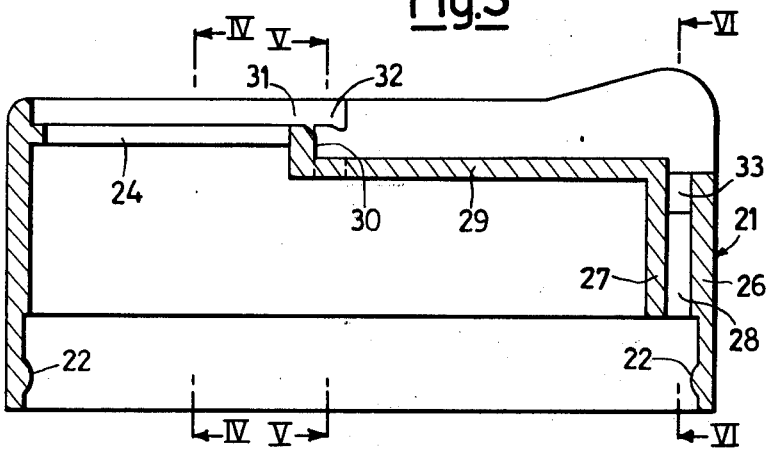
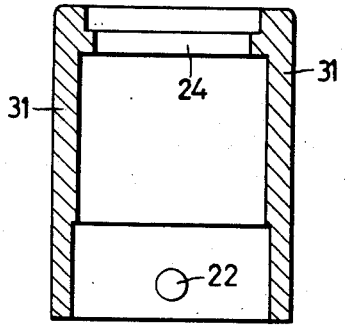
Fig.4

DISPENSING CONTAINER ASSEMBLY

FIELD OF THE INVENTION

This invention relates to a container for distributing loose solid products such as tablets, pills and the like, which hereinafter will be generally indicated as articles to be distributed or delivered; more particularly this invention relates to the closure device for the container distributor which allows the controlled distribution of one or more articles, then automatically closing the container as soon as the operation of the device ceases.

BACKGROUND OF THE INVENTION

It is well known that in the field of small products for ingesting, and particularly in the case of sweets in the form of pills, lozenges and the like, various requirements must be satisfied from the packaging point of view.

On the one hand, the package must satisfy rigid hygiene requirements, as it has to contain the articles to be distributed without these, in the majority of cases being individually wrapped and protected by paper or the like. On the other hand these sweets are normally of very low cost, because of which the package must not heavily influence the cost of the article to be sold, if it is not to lose its competitive aspect.

Finally the appearance of the package is important, and this is particularly so for the commercialization of the product.

Up to the present time the most usual packages for the articles in question consisted of tubes provided with a screwed or pressure fitted lid, or boxes provided with a hinged lid, either being normally constructed by pressing light metal.

Containers are also known in which the lid is slidable or rotatable with respect to the body of the container so as to uncover a delivery slot.

Recently moulded in plastic containers have come into use, being of substantially parallelopiped shape and provided with a lid hinged to one of the minor bases of the parallelopiped and which partially closes the base.

All the packages heretofore mentioned require a separate non-automatic operation for their closure after the delivery of one or more articles.

Furthermore with use, the closure device of the lids or the like may become damaged or otherwise be no longer satisfactory.

SUMMARY OF THE INVENTION

The main object of this invention is to provide a new container distributor for small solid articles, in particular sweets such as pills, lozenges and the like, which is provided with a distribution closure device arranged for operation by one hand and which closes automatically after each operation of distribution of at least one article.

A further object of this invention is to provide a container of the aforementioned type in which both the container body and the closure device are formed completely by molding plastics material.

These and further objects of the present invention are attained by a container distributor for small articles, in particular sweets such as pills, lozenges and the like, of the type comprising a container body and a lid hinged to the container body which closes an aperture formed in one of the bases of the body, in which said lid comprises a door-type closing part and an extension stem beyond the axis of hinging of the lid to the container body and further comprising operating means, pivoted to the container body and comprising an operating arm elastically rotatable about said pivot and arranged to engage said stem of said lid, thrusting it towards the inside of the container, and elastic means which urge said lid towards the closure position.

In the preferred embodiment of the present invention, said operating means are formed as a single body with said lid, i.e. said operating arm coincides with said stem, and said operating arm constitutes the first arm of a bell-crank lever, the second arm of which forms a shaped part arranged to seat in a corresponding cavity formed in said body, the operating means being shaped and mounted in such a manner that the rotation of said operating arm takes place about an axis different from said pivoting axis of the lid, and the return of the arm and lid into the rest position, in which the lid is closed, takes place by the natural elasticity possessed by the operating means and by the effect of the compulsory positioning of said shaped part.

The aspects and advantages of the present invention will be more evident from the following description, given by way of non-limiting example, with reference to the accompanying drawings in which:

BRIEF DESCRIPTION OF THE DRAWING

FIG. 1 is a vertical cross-section through the container according to the present invention;

FIG. 2 is an end elevational view of the container of FIG. 1, observed in the direction of the arrow F1 of it;

FIG. 3 is an enlarged section showing the upper portion of the container of FIG. 1;

FIGS. 4, 5 and 6 are sections on the lines IV—IV, V—V and VI—VI of FIG. 3 respectively;

DESCRIPTION OF PREFERRED EMBODIMENTS

Figure 5:
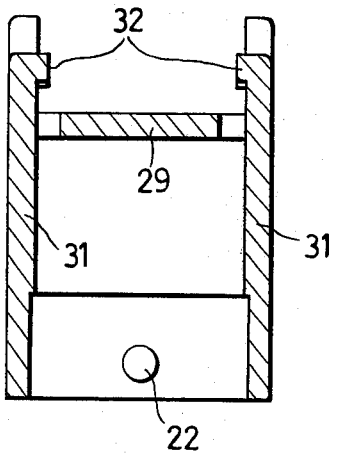
Figure 6:
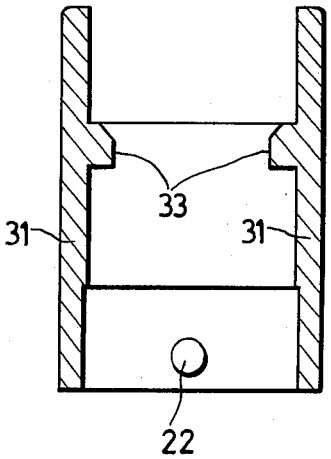
Figure 7:
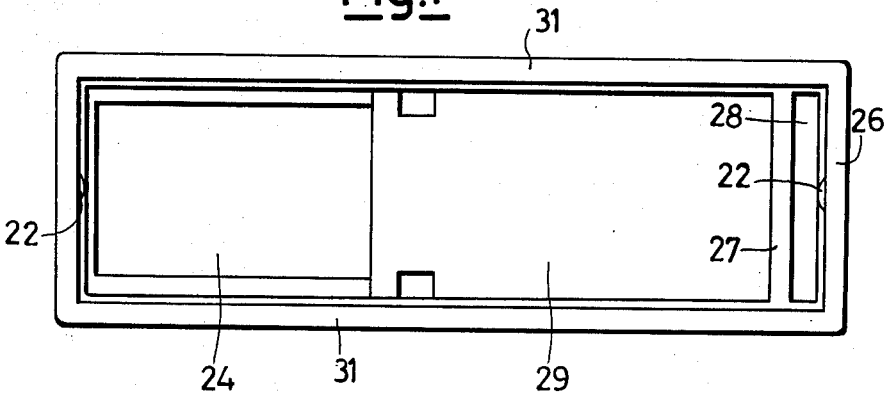
FIGS. 7 and 8 are top and bottom plan views, respectively from below and above, the portion shown in FIG. 3.
Figure 8:
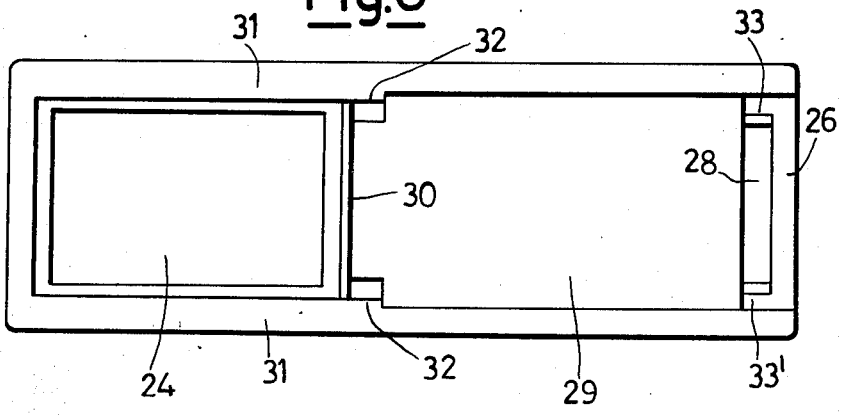

With reference to the preferred embodiment, as illustrated in FIGS. 1–12, this consists of an opened ended container body 20, which is hollow and molded in a single piece, of suitable plastics material. The container body 20 is closed by an upper cap 21, secured to the body 20 in a suitable manner, for example, by means of projections 22 which engage with holes 23.

The cap 21 comprises an upper delivery or distribution aperature 24, closed by a lid 25.

As can be clearly seen in FIGS. 1, 3, 7 and 8, cap 21 comprises, at one end, an outer wall 26 spaced from an inner wall 27 which forms with the former a seat 28 for the purpose explained hereinafter.

The cap 21 is closed by an upper wall 29, in which there is formed the delivery aperture 24, the wall 29 being disposed lower than the upper marginal edge of the cap forming a seat for the operating means which will be described hereinafter. It should be noted that the wall 29, apart from the aperture 24 closed by the lid 25, confines the product to be distributed. In particular, said wall 29 forms an intermediate step 30 at one side of the aperture 24.

The cap 21 also comprises lateral opposed side walls 31 which form two shoulders 32 (FIG. 5) at the step 30, and additional shoulders 33 (FIGS. 3 and 6) are formed at the end of the wall 29, in alignment with a cavity 28, said shoulders 32 and 33 having the purpose indicated hereinafter.

Figure 9:
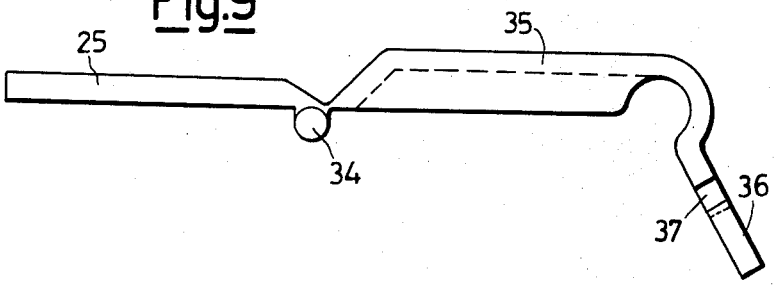
FIG. 9 is an enlarged side elevational view of the closure device and the relative operating means.
Figure 10:
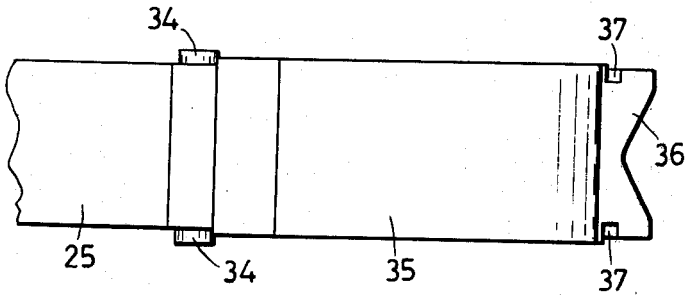
FIGS. 10 and 11 are respective top and bottom plan views of the closure device of FIG. 9.
Figure 11:
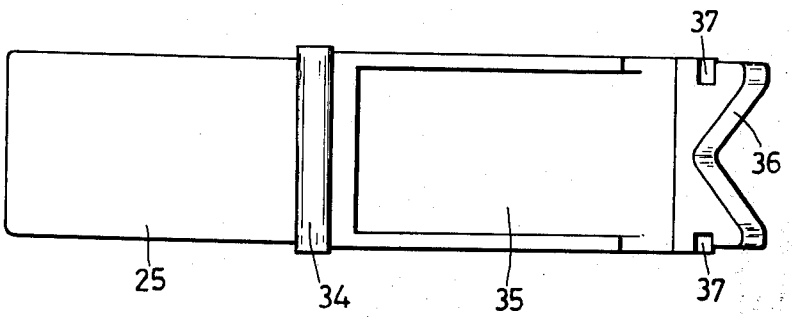
Figure 12:
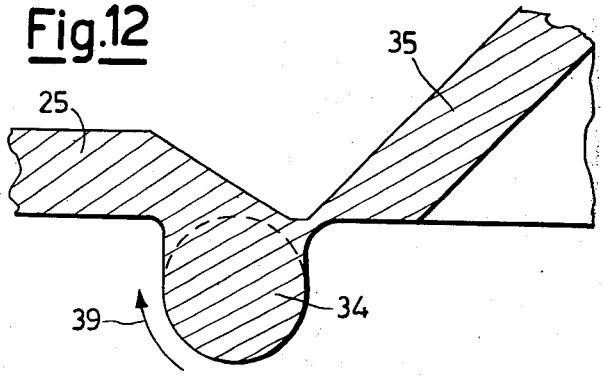
FIG. 12 is a further fragmentary enlarged detail of the device of FIG. 9.

Considering particularly the closure and operating device shown in FIGS. 9–12, this comprises, as stated, the door type lid 25, pivoted at one end by a transverse pivot 34 to the cap 21; the pivot 34 is seated by snap action underneath the shoulders 32. An operating arm 35 is formed integral with the lid 25 and pivot 34, and is arranged to be positioned in the depressed seat formed between the horizontal wall 29 and the lateral walls 31 of the cap 21. As can be clearly seen in FIG. 10, the arm 35 is shaped so as to provide strength and at the same time elasticity. The arm 35 forms part of a bell-crank lever, comprising a second depending arm 36, arranged to seat in the cavity 28. In particular, the second arm 36 comprises two symmetrically opposing recesses 37 arranged to engage the shoulders 33 of the cap 21, and in this manner lock the arm 36 in position and the entire closure and operating device. FIG. 9 shows that the connection between the arm 35 and arm 36 has a suitable hinge curvature which facilitates the rotation of the arm 35 with respect to the arm 36.

On assembly, the second arm 36 is introduced into the cavity 28 until the recesses 37 are snapped over the shoulders 33, after which the arm 35 is bent and pressed into the depressed seat over wall 29, until the pivot 34 snaps into the seat defined by the shoulders 32 and is held there by the shoulders. Consequently the lid 25 closes the aperture 24 formed in the cap 21.

When it is required to operate the closure device in order to uncover the aperture 24 for delivering an article, for example a lozenge 38, it is sufficient to press on the arm 35. This pressure causes the pivot 34 to rotate in the direction of the arrow 39 (FIG. 12) and consequently the lid 25 rotates about the axis of the pivot 34 to uncover the aperture 24. It should be noted that the point of connection and hence of action of the arm 35 is very close to the axis of the pivot 34, so that only a small movement of this point is sufficient to afford the necessary poviting to operate the lid. When the pressure on the arm 35 ceases, its elasticity and the accompanying action of the second arm 36, which acts as a return spring because of its preloading during assembly, return the lid 25 to the closure position.

It will be noted and emphasized that one of the main advantages of the container, according to the present invention; the body, the cap and especially the closure and operating device are individually molded from a suitable plastic, not only different from each other as regards color or transparency, but in particular possessing the most suitable properties for the purpose and function for which they are intended.

Furthermore, the closure and operating device has maximum simplicity and functionality.

Figure 13:
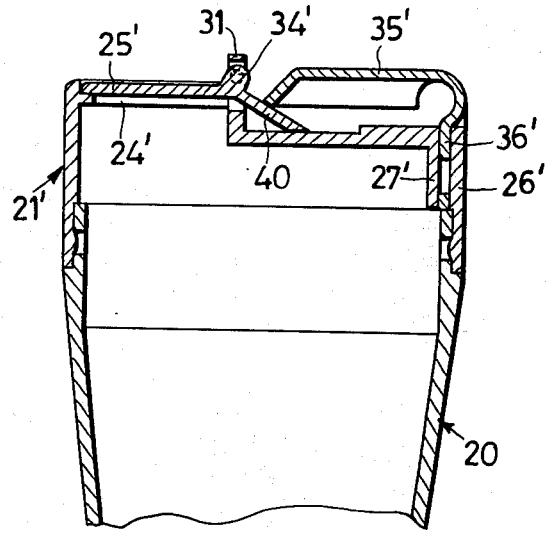
FIGS. 13 and 14 are partially sectional views of modifications of the closure device.

FIG. 13 shows a first conceptually equivalent modification of the closure and operating device according to the invention, in which like primed numbers indicate parts identical to those of the previously described embodiment. In this case, the closure and operating device is divided into two parts, in which the operating arm 35′ is not formed in a single piece with the pivot 34′ and lid 25′, but acts on a stem 40 which extends from the lid 25′ and rests on a wall 41, corresponding to the wall 29 and shaped slightly differently. In this case the stem 40 acts also as a return spring for the lid 25′ to the closure position, while the pivot 34′ is suitably pivoted to the sides 31′ of the cap 21′.

Figure 14:
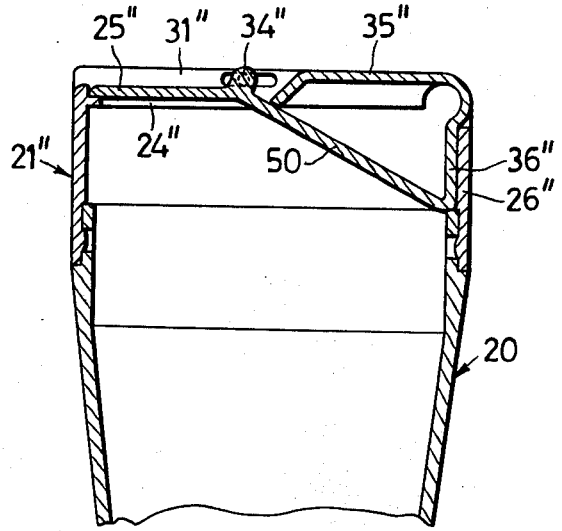

FIG. 14 shows a further modification in which the stem 50, similar to the stem 40 of FIG. 13, extends until it joins the an arm 36″ and replaces the wall 29, as seen in FIG. 14, stem 50 functions as a closure. In this case, the pivot 34″ is also suitably pivoted to the sides 31″ of the cap 21″, the pivot 34″ being provided in a slot 37″ which permits the pivot to move when the stem 50 curves under the pressure of the arm 35′.

What I claims is:

1. A container assembly for dispensing small articles such as pills, lozenges or the like, comprising:

a container body;

a dispensing-cap on said container body including a closure wall overlying said container body, said dispenser-cap including a dispensing-aperture at one side of said closure wall and above said closure wall; and a manually-operable lid assembly mounted on said dispensing-cap, said lid assembly comprising a lid juxtapositonable over said dispensing aperature for retaining the contents of the container in the container.

transverse hinge means on said lid and pivotally mounted on said dispenser-cap adjacent the juncture of the dispensing-aperture and the closure wall, an operating arm operatively connected to said transverse hinge means and overlying said closure wall, and a second arm operatively connected to said operating arm and depending therefrom and mounted on said dispensing-cap, said arms including a resilient portion therebetween whereby manual pressure on said operating arm depresses the arm toward said closure wall pivots the lid off said dispensing-aperture at the transverse hinge means, and release of manual pressure on the operating arm tends to cause the lid to pivot onto the dispensing aperture and the operatng lever to overly the closure wall.

2. The structure as claimed in claim 1 which said transverse hinge means comprises a pivot element integral with said lid and operating arm and is disposed at the juncture thereof, said dispensing cap including shoulder portions pivotally receiving said pivot element.

3. The structure as claimed in claim 1 in which said, resilient portion comprises a generally arcuate web extending transversely between adjacent ends of said arms.

4. The structure as claimed in claim 1 in which said dispensing cap includes a vertically opening slot portion receiving said second arm and dispensing cap including connection means for anchoring the second arm in said vertically opening slot portion.

5. The structure as claimed in claim 1 which said lid includes a an integral stem depending angularly onto said closure wall, said operating arm including the terminal portion abutingly engagable with said stem for depressing said stem and pivoting said lid about the transverse hinge means.

6. The structure as claimed in claim 1 in which said closure wall depends angularly from said lid, said operating arm including a terminal portion abutingly engagable with said closure wall for pivoting the lid about the transverse hinge means.

7. The structure as claimed in claim 1 which said manually operable lid assembly comprises a one-piece molded element.

8. The structure as claimed in claim 7 which said container body and dispensing-cap comprise separate one-piece molded elements.

* * * * *